US008836507B2

(12) United States Patent
Thielman et al.

(10) Patent No.: US 8,836,507 B2
(45) Date of Patent: Sep. 16, 2014

(54) WIRELESS ITEM LOSS PREVENTION SYSTEM

(75) Inventors: Scott C. Thielman, Seattle, WA (US); Keith M. Brown, Seattle, WA (US); George M. Niederauer, Seattle, WA (US)

(73) Assignee: Tether Technologies, Inc., Seattle, WA (US)

( * ) Notice: Subject to any disclaimer, the term of this patent is extended or adjusted under 35 U.S.C. 154(b) by 221 days.

(21) Appl. No.: 13/568,073

(22) Filed: Aug. 6, 2012

(65) Prior Publication Data

US 2014/0035754 A1 Feb. 6, 2014

(51) Int. Cl.
*G08B 13/14* (2006.01)

(52) U.S. Cl.
USPC ..... 340/568.1; 340/568.6; 340/539.1; 340/539.23; 340/686.6; 340/571

(58) Field of Classification Search
CPC ..... G08B 21/24; G08B 13/14; A45C 13/18
USPC ..... 340/686.6, 571, 539.1, 568.1, 568.6, 340/539.23
See application file for complete search history.

(56) References Cited

U.S. PATENT DOCUMENTS

| | | | | |
|---|---|---|---|---|
| 6,674,358 | B1 * | 1/2004 | Tinsley | 340/7.63 |
| 6,836,212 | B2 * | 12/2004 | Sawinski | 340/539.23 |
| 7,664,463 | B2 * | 2/2010 | Ben Ayed | 455/41.2 |
| 8,295,894 | B2 * | 10/2012 | Macfarlane et al. | 455/575.1 |
| 2006/0022822 | A1 * | 2/2006 | Wong et al. | 340/568.1 |
| 2008/0218343 | A1 * | 9/2008 | Lee et al. | 340/568.6 |
| 2009/0207014 | A1 * | 8/2009 | Ayed | 340/539.13 |
| 2012/0159604 | A1 * | 6/2012 | Bojinov et al. | 726/9 |

* cited by examiner

*Primary Examiner* — Eric M Blount
(74) *Attorney, Agent, or Firm* — Svendsen Legal, LLC.

(57) ABSTRACT

An item loss prevention system for protecting from the loss of items from a user, and more specifically to an electronic device utilizing a wireless connection between a remote unit attached to an item, such as a set of one or more keys, and a host or belt unit attached to the user, to prevent the loss of the item. The system includes magnetic sensors between the item and the belt, which are Hall type magnetic sensors. An alarm activates when the item attached to the remote unit, such as a key is separated from the host unit. A multiple of additional host units and the remote units pairs can operate properly in proximity to each other, and are tuned to respond to rolling average signal strength monitoring, to indicate a separation distance requiring an alarm to the user.

16 Claims, 5 Drawing Sheets

WIRELESS ITEM LOSS PREVENTION SYSTEM

TECHNICAL FIELD

This invention relates generally to the field of electronic item loss protection, and more specifically to a device utilizing a wireless connection between an item and a belt to prevent loss of the item, including magnetic sensors between the item and the belt, and an alarm that activates when the item, such as a key, is separated from the belt or host unit.

BACKGROUND OF THE INVENTION

All secure areas of conventional building structures have the need for keys, typically carried by persons for purposes of accessing these secure areas. The key may be a standard metallic 'hard' key, or newer electronic and 'swipe' types of keys. There is an inherent risk when keys are carried by persons, in that the keys may be lost or misplaced and in many cases unrecoverable and irreplaceable. Additionally, a lost or misplaced key is a real and potentially debilitating security threat to the building and its secure contents. Typically, a significant investment is required to re-pin or re-key a door or access point, and the loss of a master key may require the re-keying of an entire facility or building.

Responding to this significant risk, many organizations attempt to mitigate the potential loss by designing and implementing 'key control procedures.' These procedures limit personnel's access to keys or at least to master keys, and may require an authorized individual to sign keys in and out. In many cases, the individual must relinquish personal identification to establish positive custody of the key. Often the key holder's personal identification card is held until the keys are safely returned and accounted for.

Other items may need to be kept secure in much the same manner as conventional keys. The item may be any need element of a security system, such as an identification card, data chip or hard-drive, valuable or container. Again, there is an inherent risk when any item is carried by persons, in that the item may be lost or misplaced and in many cases unrecoverable and irreplaceable. Additionally, a lost or misplaced item is potentially non-replaceable, even with adequate insurance, which may be too exorbitant to acquire in coverage of potential loss.

A need exists for the institutional control of items including keys, which involves a more simple and efficient procedure or system for the issuance and tracking of the items. Currently, there are many item loss prevention and tracking devices, but none provide the needed a foolproof and reliable handling of keys and other items, as required for high security facilities and in the transfers of valuable or high security items, such as banks, hospitals, government offices and other secure buildings. A preemptive item loss system is needed that eliminates the lost time, security breaches and costly repercussions due to lost keys.

The present invention provides the needed control of keys that efficiently tracks and prevents the loss or misplacement of keys. This control is required for typical institutional facilities and other secure buildings or structures. The present invention will be better understood by reference to the following detailed description taken in conjunction with the accompanying drawings.

BRIEF DESCRIPTION OF DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF SPECIFIC EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

For the purposes of explanation, specific embodiments are set forth to provide a thorough understanding of the present invention. However, it will be understood by one skilled in the art and from the reading the disclosure, that the invention may be practiced without these details. Moreover, well-known elements, process steps and the like, and including, but not limited to, mechanical components, electronic circuitry components and connections, are not set forth in detail in order to avoid obscuring the disclosed system.

Designed as a proactive way to prevent items, such as keys, from being misplaced or lost, the item loss prevention system of the present invention uses an electronic wireless 'tether,' to keep a remote item, such a key ring within a separation distance or radius of approximately ten to fifteen steps from the user. Alarms on both the remote item unit and a belt attachable unit are initiated, if the remote item moves beyond the specified radius of separation, thus eliminating the loss of the remote item. This system is preemptive, in that it is able to eliminate lost time, security breaches and costly repercussions due to a loss of important items.

Figure 1:
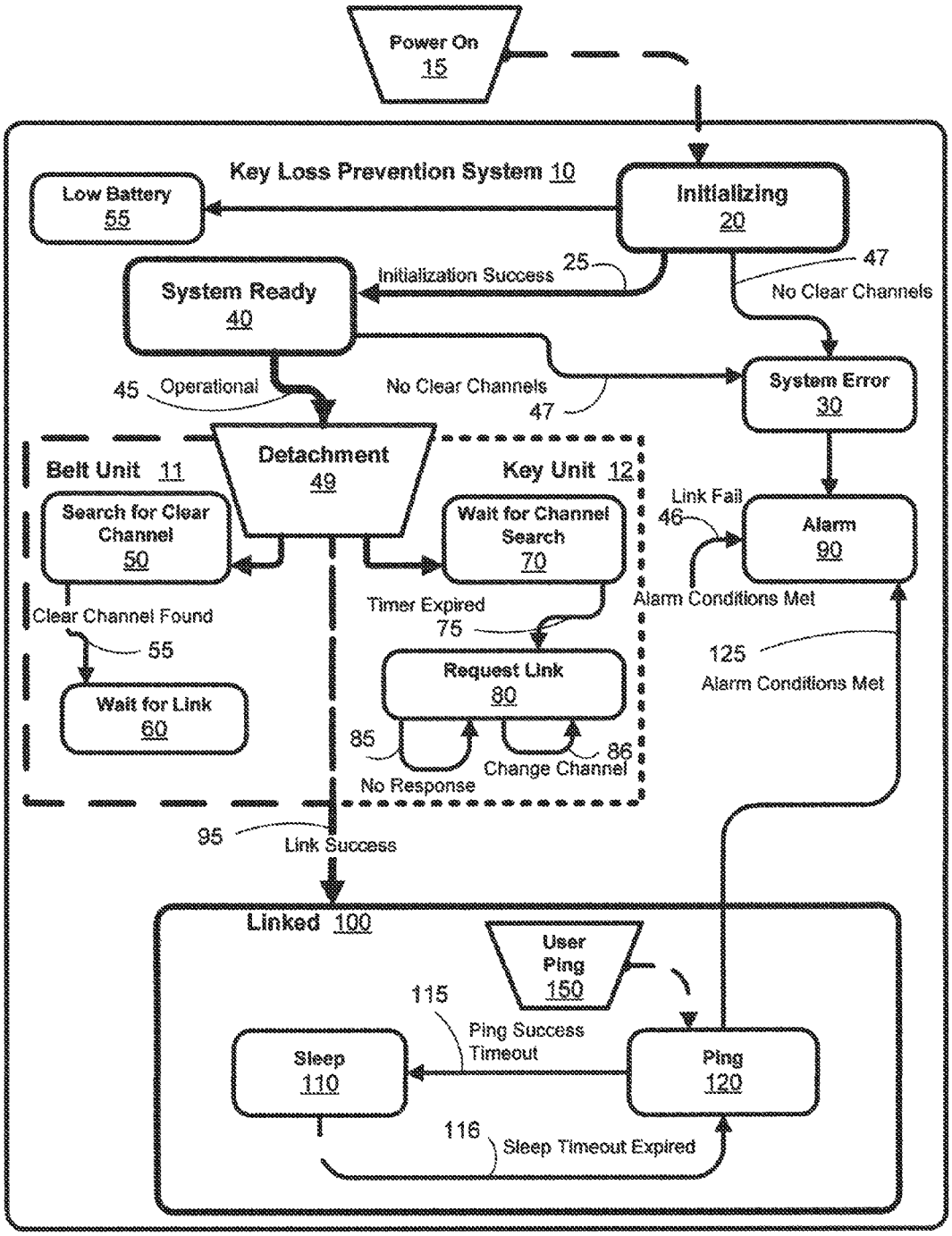
FIG. 1 is an operational schematic diagram of an item loss prevention system, detailing features according to an embodiment of the invention.

FIGS. 1 through 4 show aspects of an item loss prevention system 10, in accordance with a preferred embodiment of the present invention. Specifically, FIG. 1 shows a schematic view of an operational method of this preferred embodiment of the item loss prevention system. An Initializing 20 of the system preferably results from a manual Power On 15 from a user 14 of the item loss prevention system.

Figure 3:
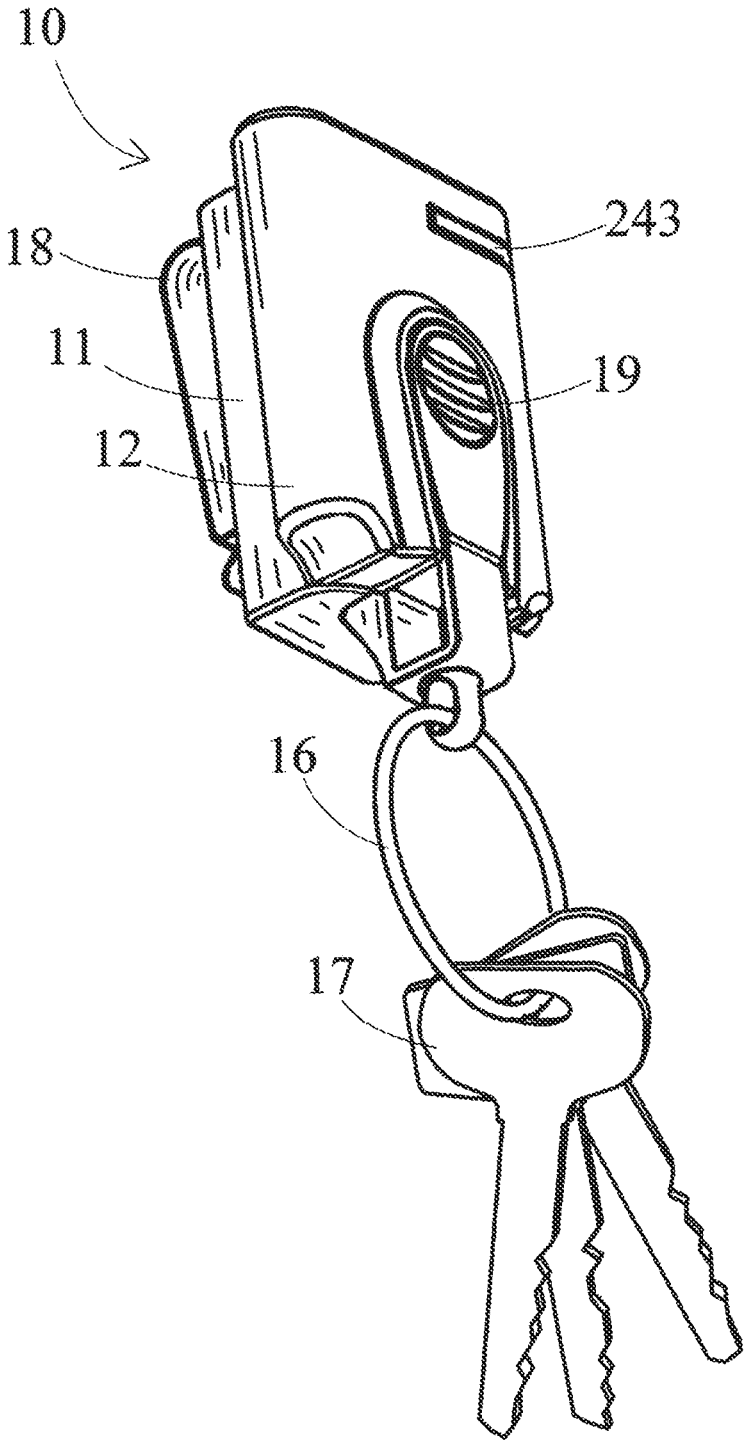
FIG. 3 is a perspective view of the item loss prevention system, according to an embodiment of the invention.
Figure 4:
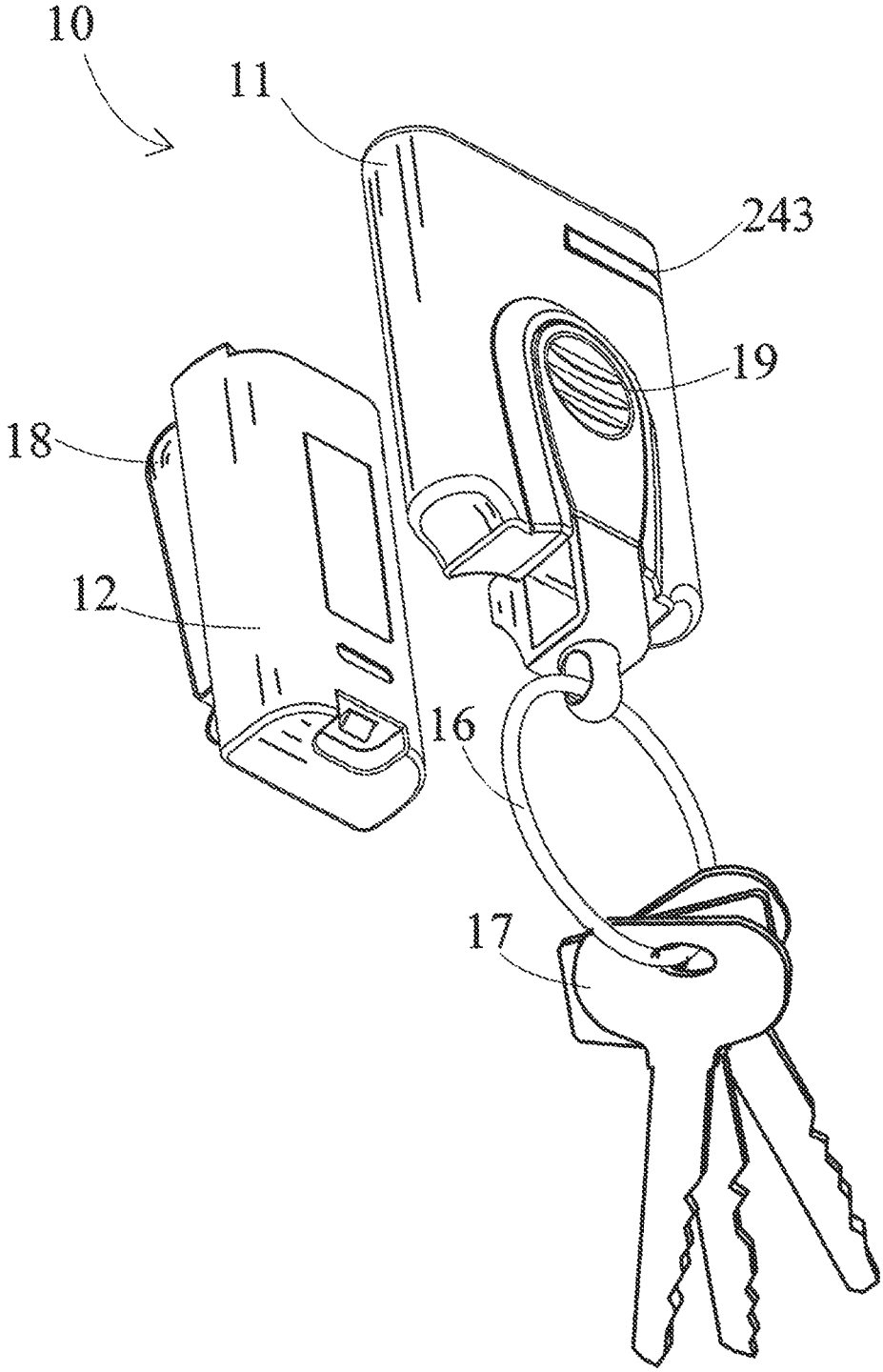
FIG. 4 is a perspective view of the item loss prevention system, according to an embodiment of the invention.

Most preferably, the Item Loss Prevention System 10 is a two-unit system, employing a Belt Unit 11 that receives a Remote Unit 12. An item 17 is attached to the Remote Unit, and as shown in FIGS. 3 and 4, the item preferably includes a key ring 16 with a set of one or more keys 19. The Belt unit preferably includes a belt clip 18 that is receivable onto the user 14, preferably on the user's belt or similar functioning strap, holster or clothing article. The Belt Unit may also be referred to herein and in the attached claims as a "host unit,"

in that is not required to be attached to a belt, or include the belt clip, but only that it is attachable to or receivable onto the user.

Figure 2A:
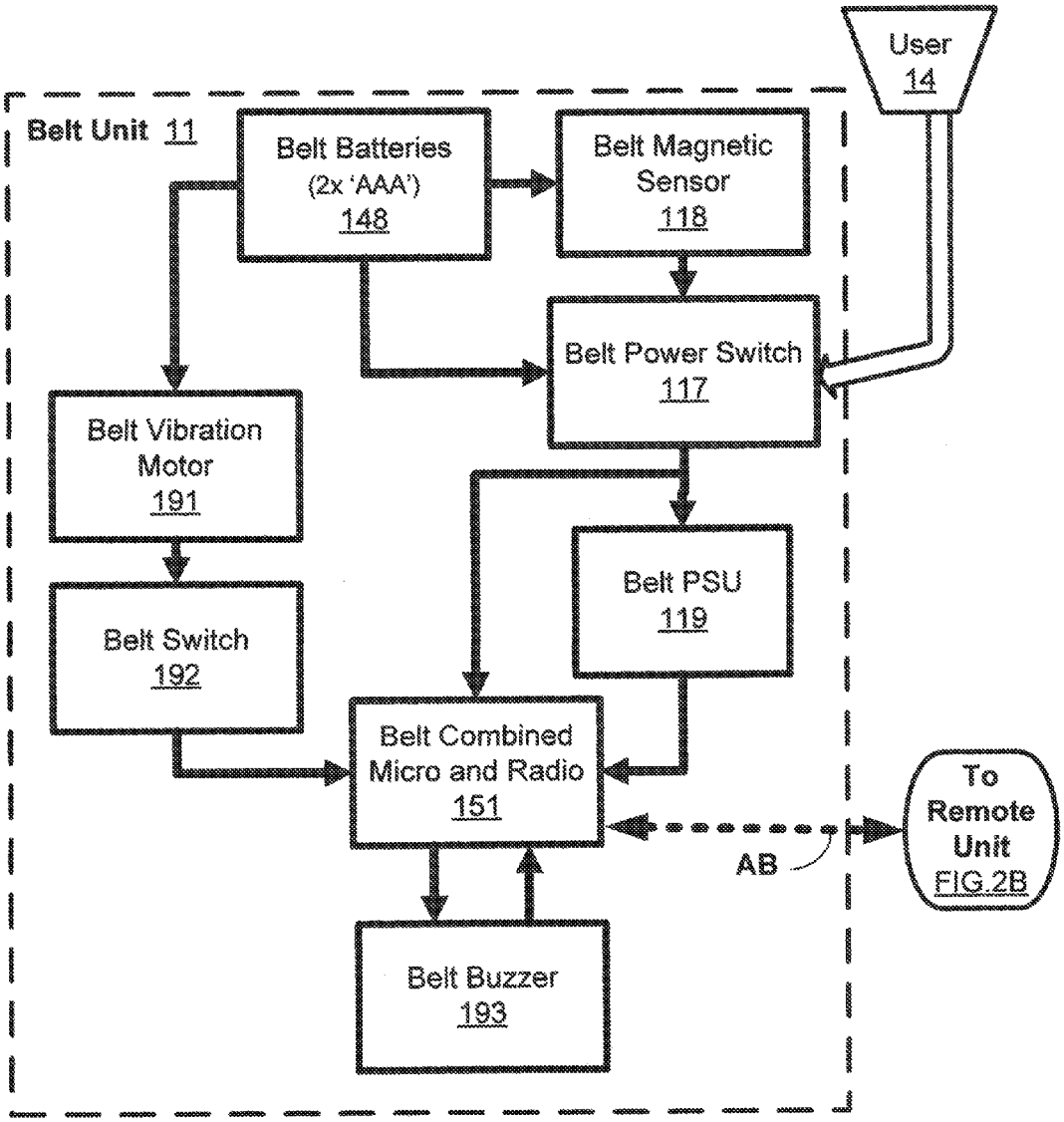
FIG. 2A is a component schematic diagram of a belt portion of the item loss prevention system, detailing features according to an embodiment of the invention.
Figure 2B:
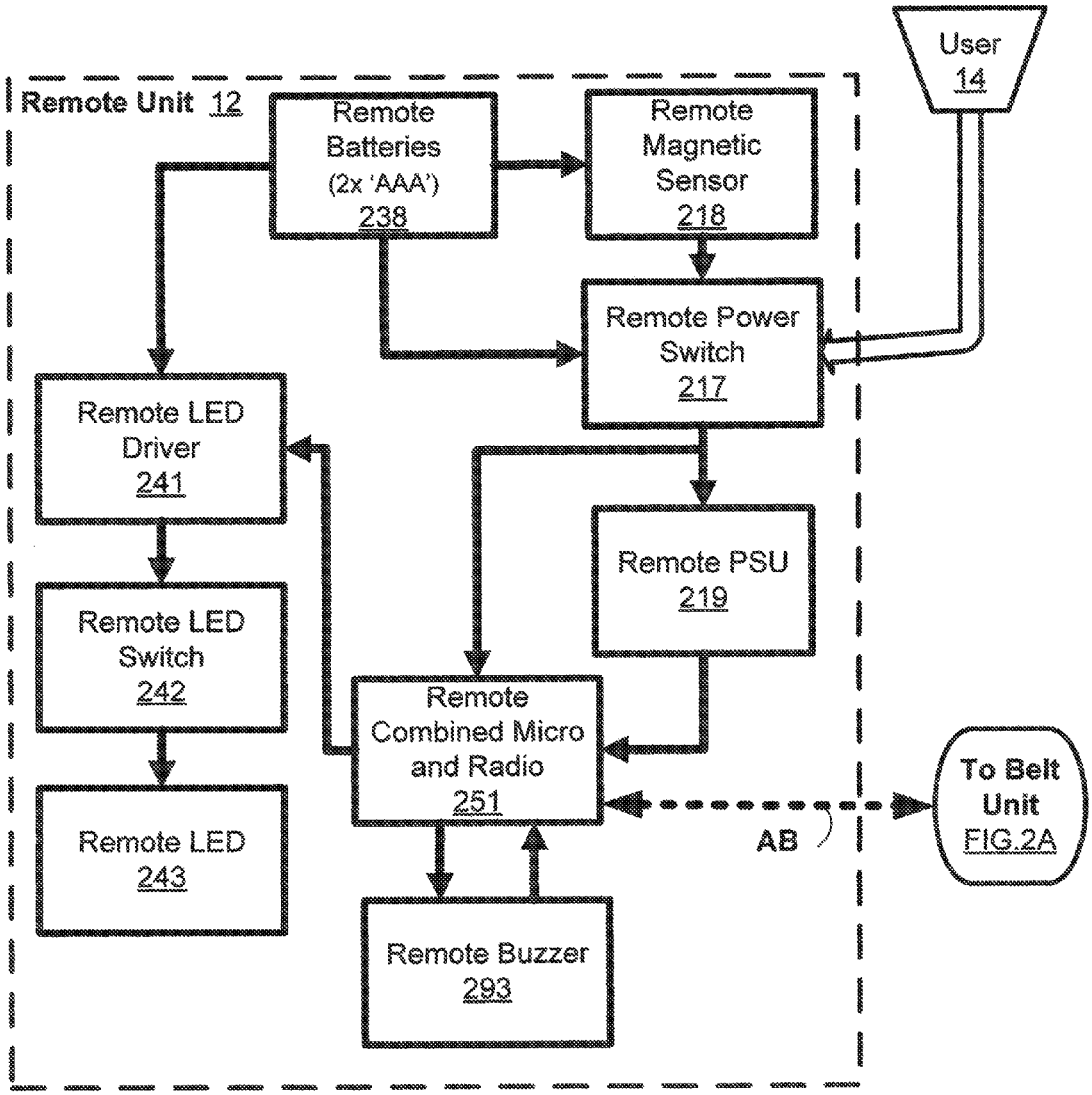
FIG. 2B is a component schematic diagram of a remote portion of the item loss prevention system, detailing features according to an embodiment of the invention.

The operation of the Item Loss Prevention System 10 is shown schematically in FIG. 1, with the component parts of the Belt Unit 11 shown in FIG. 2A, and the component parts of the Remote Unit 12 are shown in FIG. 2B.

Referring to FIG. 1, after the Power On 15 is received by the Item Loss Prevention System 10, the Initializing 20 includes pre-checks such as power stabilization of the electromechanical components, and an initial check for clear channels of radio communication for use by the Belt Unit 11 and the Item Unit 12.

An Initialization Success 25 brings the Item Loss Prevention System to a System Ready 40, which maintains an Operational 45 status mode to the belt unit and item unit, until an alarm condition or failure occurs. One such failure could be a Low Battery 55 state that is entered if the Initializing 20 monitors the Belt Batteries 148 or the Remote Batteries 238 have a power output or charged level below a predetermined setting.

Upon Initializing 20, or during the System Ready 40, if No Clear Channels 47 are found, the System Error 30 is reached. The System Error 30 may result in an Alarm 90 state, with a lighting of a LED or some similar lighted notification to the user 14 of the Item Loss Prevention System 10. With the System Ready, a Detachment 49 of the Remote Unit 12 from the Belt Unit initiates a Search for Clear Channel 50 by the Belt Unit 11, and a Wait for Channel Search 70 by the Remote Unit 12.

The Search for Clear Channel 50 by the Belt Unit 11 continues until a Clear Channel Found 55 results. Simultaneously, a Wait for Channel Search 70 is initiated by the Remote Unit 12. The Belt Unit then enters a Wait for Link 60 state, until a Link Success 95. If the Remote Unit fails to receive the Search for Clear Channel 50 from the Belt Unit, after a Timer Expired 75, a Request Link 80 is broadcast by the Remote Unit. If No Response is received by the Remote Unit, a Chanel Change 86 is then initiated, and the Request Link retried.

The hosting Belt Unit 11 and the Remote Unit 12 communicate wirelessly, using a signal quality to judge a length or distance of separation. The Host Unit notifies the user 14 with an Alarm 90, when a Link Failure 46 occurs as an alarm condition. This Alarm 90 condition is met if the signal received from the Remote Unit by the Host Unit falls below a threshold of separation value. The Remote Unit also notifies the user 14 with the Alarm when a threshold of separation value is exceeded for the signal from Host Unit to Remote Unit. By working in both directions between the Host Unit to the Remote Unit and visa-versa, a case is avoided where disabling one side of the Belt Unit or Remote Unit pair disables the entire Item Loss Prevention System 10.

The signal quality between communications between the hosting Belt Unit 11 to the Remote Unit 12 employed to judge the length of separation includes a sample interval, which is a preset time interval that is assigned an instantaneous value that moves or 'rolls' over time. The instantaneous value is employed to calculate a rolling value, and the rolling value is compared to the preset threshold of separation value, for initiating the alarm condition notification to the user 14. The rolling value is calculated by an aggregating a series of the instantaneous values and comparing this aggregate to the signal quality threshold. Each instantaneous value below the noise background serves to arithmetically cancel an instantaneous values above the signal quality threshold.

The Link Success 95 results when the radio frequency link is achieved over an otherwise clear channel, between the Belt Unit and the Remote Unit. This results in a Linked 100 state for the Item Loss Prevention System 10, as shown in FIG. 1. To conserve battery power, the link is not maintained constantly, instead the Item Loss Prevention System enters a Sleep 110, followed by a Ping 120 at regular intervals. From the Sleep mode, a Sleep Timeout Expires 116 to initiate the Ping, and after a Ping Timeout Success 115, the Item Loss Prevention System reenters the Sleep mode. Additionally, a User Ping 150 may be initiated by the user 14, which manually generates the Ping, without waiting for the Sleep Timeout Expires process step.

If the Ping 120 fails, being that no linked response is received between the Belt Unit 11 and the Remote Unit 12, a signal of the Link Failure 46 resulting in an Alarm Conditions Met 125 is generated, and the Alarm 90 state is entered with a lighting of a LED or some similar lighted notification to the user 14 of the Item Loss Prevention System 10.

Though digital "handshake" and authentication protocols, as known to those skilled in the field of electronic device interfacing, the hosting Belt Unit 11 and the Remote Unit 12 communicate with each other and exclude communications with all other wireless item loss prevention systems. With unique identifications and authentication with each Link Success 95 function and with each Initialization Success 25 function, a multiple of pairs of Belt Units and coupled Remote Units can operate properly in proximity to each other.

FIG. 2A details the interrelationship of component parts of the Belt Unit 11. The user 14 manually activates a Belt Unit Power Switch 117, preferably mounted to the top of the Belt Unit. The Belt Unit Power Switch controls power to the Belt PSU 119, and power to the Belt Combined Micro and Radio 151. The Belt Combined Micro and Radio includes microprocessor logic functions, as detailed in FIG. 1, along with radio features for communicating with a Remote Combined Micro and Radio 251, as present in the Remote Unit 12. The Remote and Belt Combined Micro and Radios employ standard RF signal generators to communicate with each other. Additionally, channel scan and search features are employed, as detailed in FIG. 2, to prevent the use of busy or noisy frequencies or channels. As discussed above, the Item Loss Prevention System 10 is a two-unit device employing the radios within the Belt Unit the Remote Unit as an 'electronic tether,' to keep the item 17 on the Remote Unit within an approximate fifteen meter radius away from the user, who wears the hosting Belt Unit on their person. The Belt Combined Micro and Radio communicates with the Remote Combined Micro and Radio along a path AB, as shown in FIGS. 2A and 2B.

Preferably, the Remote Unit 12 easily removes from the Belt Unit 11 by the user 14 pressing on a Thumb Release 19, as shown in FIG. 4. The Remote Unit can be returned to the Belt Unit with a simple click and snap back together, as shown in FIG. 3. An important feature of the Item Loss Prevention System 10 is the use of magnetic sensors on both the Remote and Belt Units, to monitor the presence of the Remote Unit in the cradling Belt Unit or the absence of the Remote Unit from a direct contact with the Belt Unit. Specifically, a Belt Magnetic Sensor 118 is employed in the Belt Unit and a Remote Magnetic Sensor 218 is employed in the Remote Unit. Both magnetic sensors are most preferably Hall type integrated circuits, which are magnetic switches that can operate 'omnipolar,' with both S-pole and N-pole, to independently begin the Initializing 20 function in both the Belt Unit and the Remote Unit. The use of the dual magnetic switches is critical to the efficiency and reliability of the Item Loss Prevention System, in that a significant reduction in false alarms and improved operation of the Initializing and System Ready 40 function were realized.

If the item 17 on the Remote Unit 12 move beyond the ten to fifteen meters, or other preset distance from the Belt Unit 11, both the Belt Unit and the Remote Unit immediately respond with unique alarms. The Belt Unit on the user 14 vibrates by action of a Belt Vibration Motor 191, and emits a chirp alert by action of a Belt Buzzer 193. The Belt Vibration Motor is preferably a standard 3 Volt DC 'rumble pack' style motor, and the Belt Buzzer is preferably a differentially driven piezo type of audible buzzer, with a tone and variable pulse generation capability. The Remote Unit also sounds an alarm, preferably with a Remote Buzzer 293 that is also a piezo type most preferably of the same type as the Belt Buzzer, but louder to reach the remote user. Additionally the Remote Unit includes a Remote LED 243, which is preferably a 'FIB' type of bright LED warning strobe.

As shown in FIG. 2A, the Belt Vibration Motor 191 is controlled by a Belt Switch 192, which in turn is controlled by the Belt Combined Micro and Radio 151. The Belt Combined Micro and Radio also controls the Belt Buzzer 193. Similarly, as shown in FIG. 2B, the Remote LED 243 is controlled by a Remote LED Switch 242 connected directly to a Remote LED Driver, which in turn is controlled by the Remote Combined Micro and Radio 251. The Belt Combined Micro and Radio controls the Belt Buzzer 193, just as the Remote Combined Micro and Radio likewise controls the Remote Buzzer 293. The buzzers, LED and vibrational motors of both the Remote and Belt Units are activated as part of the Alarm 90 function, as shown in FIG. 2.

In the event of the Item Loss Prevention System 10 entering the Alarm 90, there are three alarms that engage. The Belt Unit 11 and the Remote Unit 12 each emit a combination of unique alarms, including vibrations generated by the Belt Vibration Motor 191, audio signals generated by the Belt Buzzer 193 and the Remote Buzzer 293, and visual signals generated by the strobing of the Remote LED 243. This combination of alarms makes identifying the location of the Remote Unit and attached item 17 quick and fool-proof for the user 14. Preferably, an additional alarm is included in the Low Battery 50 function, as shown in FIG. 1. However, for the preferred standard 'AAA' batteries perform with an average life of six months for both the Belt Batteries 148 and the Remote Batteries 238. Once either set of batteries reaches 20% of usable charge, a warning light on the Belt Unit or Remote Unit can serve to alert the user.

The Item Loss Prevention System 10 functions as an electronic tether to keep the item 17, as attached to the Remote Unit 12, within a ten to fifteen-step radius of the user 14, who wears the Belt Unit 11. If the item, such as the key ring 16, travel more than the preset ten to fifteen steps from the Belt Unit, both the Belt Unit and the Remote Unit immediately respond with unique alarms. The Belt Unit on the user also vibrates and preferably emits a 'chirping' alert while the Remote Unit sounds a loud alarm of up to 80 dB, and emits a bright LED warning strobe.

Most preferably, the Item Loss Prevention System 10 is designed for industrial environments with durable and long-lasting usability. The vibration feature can be felt through heavy clothing or belts. The Item Loss Prevention System can be utilized in a wide variety of industries including; security, janitorial, property and facility management, hospitality, health care, and law enforcement or correction facilities.

Again, while the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above, for instance in the application to crop drying and crop cooling systems and methods. Therefore, the invention is not to be limited except by the following claims, as appropriately interpreted in accordance with the 'doctrine of equivalents.'

The following is claimed:

1. An item loss prevention system comprising:

a host unit that receives a remote unit, the remote unit attachable to an item, the host unit receivable onto a user; and a remote magnetic sensor on the remote unit and a host magnetic sensor on the host unit, the host magnetic sensor and the remote magnetic sensor independently monitor a presence or an absence of the remote unit from a direct contact with the host unit, and the host magnetic sensor initiates a host initializing function in the host magnetic unit when the host magnetic sensor detects the absence of the remote unit, and the remote unit initiates a remote initializing function in the remote unit when the remote magnetic sensor detects the absence of the host unit.

2. The item loss prevention system of claim 1, wherein the host unit magnetic sensor and the remote magnetic sensor are Hall type sensors.

3. The item loss prevention system of claim 1, wherein the remote unit includes a key ring for receiving a set of one or more keys.

4. The item loss prevention system of claim 1, wherein the host unit and the remote unit communicate with each other so that a multiple of pairs of the host units and the remote units can operate properly in proximity to each other.

5. The item loss prevention system of claim 1, wherein:

the host unit and the remote unit communicate wirelessly with one another, using a signal quality to judge a length of separation, and the host unit notifies the user with an alarm condition when a signal received from the remote unit by the host unit falls below a threshold of separation value.

6. The item loss prevention system of claim 5, wherein:

the signal quality used to judge the length of separation includes a sample interval;

the sample interval is assigned an instantaneous value;

the value employed to calculate a rolling value; and the rolling value is compared to the threshold of separation value for initiating the alarm condition notification to the user.

7. The item loss prevention system of claim 6, wherein:

the rolling value is calculated by a comparing a series of the instantaneous values and to a signal quality threshold and each instantaneous value below the signal quality threshold serves to arithmetically cancel an instantaneous values above the signal quality threshold.

8. The item loss prevention system of claim 1, wherein:

the host unit and the remote unit communicate wirelessly with one another, using a signal quality to judge a length of separation, and the remote unit generates an alarm condition when a signal received from the host unit by the remote unit falls below a threshold of separation value.

9. The item loss prevention system of claim 8, wherein:

the signal quality used to judge the length of separation includes a sample interval;

the sample interval is assigned an instantaneous value;

the value employed to calculate a rolling value; and the rolling value is compared to the threshold of separation value for initiating the alarm condition notification to the user.

10. The item loss prevention system of claim 9, wherein:

the rolling value is calculated by a comparing a series of the instantaneous values and to a signal quality threshold and each instantaneous value below the signal quality threshold serves to arithmetically cancel an instantaneous values above the signal quality threshold.

11. An item loss prevention system comprising:

a host unit that receives a remote unit, the remote unit attachable to an item, the host unit receivable onto a user;

a remote magnetic sensor on the remote unit and a host magnetic sensor on the host unit, the host magnetic sensor and the remote magnetic sensor independently monitor a presence or an absence of the remote unit from a direct contact with the host unit, and the host magnetic sensor initiates a host initializing function in the host magnetic unit when the host magnetic sensor detects the absence of the remote unit, and the remote unit initiates a remote initializing function in the remote unit when the remote magnetic sensor detects the absence of the host unit; and the host unit and the remote unit communicate wirelessly with one another, using a signal quality to judge a length of separation, and the host unit notifies the user with an alarm condition when a threshold of separation value is exceeded between the host unit and the remote unit.

12. The item loss prevention system of claim 11, wherein the host unit magnetic sensor and the remote magnetic sensor are Hall type sensors.

13. The item loss prevention system of claim 11, wherein the remote unit includes a key ring for receiving a set of one or more keys.

14. The item loss prevention system of claim 11, wherein the host unit and the remote unit communicate with each other so that a multiple of additional host units and the remote units pairs can operate properly in proximity to each other.

15. The item loss prevention system of claim 14, wherein:

the signal quality used to judge the length of separation includes a sample interval;

the sample interval is assigned an instantaneous value;

the value employed to calculate a rolling value; and the rolling value is compared to the threshold of separation value for initiating the alarm condition notification to the user.

16. The item loss prevention system of claim 15, wherein:

the rolling value is calculated by a comparing a series of the instantaneous values and to a noise background and each instantaneous value below the noise background serves to arithmetically cancel an instantaneous values above the noise background.

* * * * *